US007165555B2

(12) United States Patent
Lee

(10) Patent No.: US 7,165,555 B2
(45) Date of Patent: Jan. 23, 2007

(54) MANICURE SPA BATH DEVICE

(75) Inventor: Cherra Lee, Nashville, TN (US)

(73) Assignee: Cherra Y. Lee, Nashville, TN (US)

( * ) Notice: Subject to any disclaimer, the term of this patent is extended or adjusted under 35 U.S.C. 154(b) by 134 days.

(21) Appl. No.: 10/963,118

(22) Filed: Oct. 12, 2004

(65) Prior Publication Data

US 2006/0076028 A1 Apr. 13, 2006

Related U.S. Application Data

(60) Provisional application No. 60/509,927, filed on Oct. 9, 2003.

(51) Int. Cl.
*A47K 3/022* (2006.01)
*A45D 29/18* (2006.01)
*A61H 1/00* (2006.01)

(52) U.S. Cl. ..... 132/73.5; 601/17; 4/621

(58) Field of Classification Search ..... 132/73.5, 132/73.6, 74.5; 601/15, 17, 22, 156–158, 601/168; 4/621, 622
See application file for complete search history.

(56) References Cited

U.S. PATENT DOCUMENTS 1,060,236 A * 4/1913 Dodge ..... 4/622
4,880,415 A * 11/1989 Urakami ..... 604/291
5,947,131 A * 9/1999 Kim ..... 132/200
6,234,180 B1 * 5/2001 Davis et al. ..... 132/74.5
6,309,366 B1 * 10/2001 Maxwell ..... 601/166
6,695,800 B1 * 2/2004 Gary et al. ..... 601/154
6,725,471 B1 * 4/2004 Ferber et al. ..... 4/622
6,973,683 B1 * 12/2005 Lev et al. ..... 4/622
2003/0220593 A1 * 11/2003 Morton ..... 601/15

FOREIGN PATENT DOCUMENTS

DE 3214335 * 10/1983

* cited by examiner

*Primary Examiner*—Todd E. Manahan
*Assistant Examiner*—Rachel Running

(57) ABSTRACT

The invention relates to a cosmetology manicure spa bath for two hands, wherein the user's nails and hands receive pulsating, heated jets of liquid solution. The basin of the invention is disposed at a declining angle from the user. The receiving area in the invention for the two hands is disposed within the basin and is comprised of two depressions generally in the shape of a hand, with raised projections distributed within these two depressions for massaging the hands while keeping the hands from touching the bottom of these depressions. Features of the invention include at least one wrist rest, at least one built in nail brush, and a manicure implement receptacle.

7 Claims, 4 Drawing Sheets

MANICURE SPA BATH DEVICE

CROSS-REFERENCE TO RELATED APPLICATIONS

The present application claims the benefit of the filing date of Provisional Application 60/509,927 filed on Oct. 9, 2003, which is incorporated herein in its entirety.

BACKGROUND OF THE INVENTION

The present invention relates generally to a spa bath device, and more particularly to a temperature regulated device utilizing mini-jets to facilitate the preparation of the cuticles prior to a manicure in an efficient and effective manner while providing a spa experience for the client.

As part of the manicure process, it is desirable to soften the cuticles so that they may be removed or pushed back. One technique for accomplishing this involves soaking the fingers in a hot solution in a bowl. Another technique is to insert the client's hand in a disposable plastic bag, apply a room temperature solution to the cuticle area of each hand and then insert the client's hands into a plastic heating pad that is designed for insertion of two hands.

Various devices have been developed for preparing a client's hands for manicuring or for related treatments. For example, U.S. Pat. No. 6,695,800, issued to Gary et al., describes a device for treating a user's hand with a treatment fluid.

U.S. Pat. No. 4,441,487, issued to Daugherty et al., describes a device with a contoured, hollow hand-rest which supports the hand with the fingers in outstretched separate positions, and which is centered in a shallow container including a semi-annular barrier of oil-soaked sponge against which the fingernails and cuticles rest, and additionally includes means for heating the oil above room temperature.

U.S. Pat. No. 4,307,738, issued to Barns describes a heated bath device for preparing fingernails for manicuring.

U.S. Pat. No. 4,020,856, issued to Masterson, describes a fingernail and hand cleaning apparatus having a liquid cleaning solution pumped through jets. This results in softened cuticles. No heating means are used.

U.S. Pat. No. 2,245,929, issued to Mangold, describes a manicure tray for soaking fingers and the nails. The tray has multiple compartments, for the hand to be placed in while the finger and nails are soaked, and for bottles of oil and cuticle remover, as well as other materials needed for the treatment. The Mangold device has soaking compartments for the nails but no heater or jets.

While the above reference patents are a step in the right direction in providing a manicure device, there remains room for additional improvements. For example, there remains a need for a spa device that can accommodate both hands simultaneously. Solving this need would allow a manicurist to service multiple clients at the same time. Also, solving this need could decrease the time for a client to get a manicure, allowing busy clients to both have a spa experience but also to have the option to go to their next activity faster.

Additionally, there is a need in the manicure industry for ways to provide more value to clients. Providing more value can translate to improving client retention, as well as to increasing revenue for the manicurist and the shop owner. It is well known in the art that providing a spa experience to a client increases client satisfaction and increases the perceived value of the experience by the client. Having a moving, heated solution contact the client's body can create this desired perception. For those whose livelihood depends on manicuring, solving this problem can be helpful.

The present invention is directed toward meeting the above needs, among others.

The foregoing patents and other information reflect the state of the art of which the inventor is aware and are tendered with a view toward discharging the inventor's acknowledged duty of candor in disclosing information that may be pertinent to the patentability of the present invention. It is respectfully stipulated, however, that the foregoing patent and other information do not teach or render obvious, singly or when considered in combination, the inventor's claimed invention.

BRIEF SUMMARY OF THE INVENTION

The present inventions are directed toward devices that assist in the preparation of hands, and especially cuticles, for further treatment, such as in the manicuring process. The present inventions are directed towards allowing the user to submerge both hands into a solution at the same time. The present inventions are also directed towards the stimulation of the hands, the softening and conditioning of the hands, and the loosening of embedded soil and/or grime on the hands or embedded under the nail bed.

In one embodiment of the present inventions, the spa bath device includes a housing with a basin and a solution in the basin. The device employs jets and air compression means to provide a continuous flow of solution against the submerged parts of the hands to be treated, e.g. the cuticles. The device also employs variable heating means to raise the solution above room temperature. One or more wrist rests are disposed on the upper portion of the housing closest to the user. Two recessed areas (depressions) are disposed in the basin in alignment with these wrist rests. Each depression is generally shaped for placing a hand within the depression: the depression on the left being shaped for placement of a left hand, and the depression on the right being shaped for placement of a right hand. Within each depression a plurality of massage beads are disposed. Means for filling and empting the basin are disposed in the housing. At least one compartment for manicure related items is disposed on the top of the housing closest to the manicurist. The central portion of the back side of the housing closest to the manicurist may be curved away from the manicurist.

The housing is made of any suitable plastic material which is inert under the conditions of use. The housing is formed by molding, e.g. injection molding. The depth of the bottom of the basin goes from shallow to deep from the front portion of the basin to the back portion of the basin. The front edge of the top of the housing is wide enough to provide a place to rest the hand while the fingers are in the bath. Inside the housing is a low voltage DC motor enabled for air compression that is connected to the mini jet assembly. Also within the housing is a resistance heater for warming the solution. The solution can be water, a soapy aqueous solution, an aqueous quaternary ammonium salt lotion, a vitamin A lotion, combinations of the above, and the like. The additives increase the cleaning and softening effects of the heated bath. Other known additives can be used to achieve specific desired effects.

One objective of the present inventions is to provide a spa manicure bath that allows the user to insert both hands simultaneously in treatment fluid.

Another objective of the present inventions is to provide a spa manicure bath that gives a pleasant experience to the user.

Another objective of the present inventions is to provide a spa manicure bath that is easy to use.

Another objective of the present inventions is to provide a spa manicure bath that is made of inexpensive, readily available materials and components.

There has thus been outlined, rather broadly, the more important features and benefits of the invention in order that the detailed description thereof that follows may be better understood, and in order that the present contribution to the art may be better appreciated. There are additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

Other advantages and features of the invention are described with reference to exemplary embodiments, which are intended to explain and not to limit the invention, and are illustrated in the drawings in which.

DETAILED DESCRIPTION OF THE INVENTION

Figure 1:
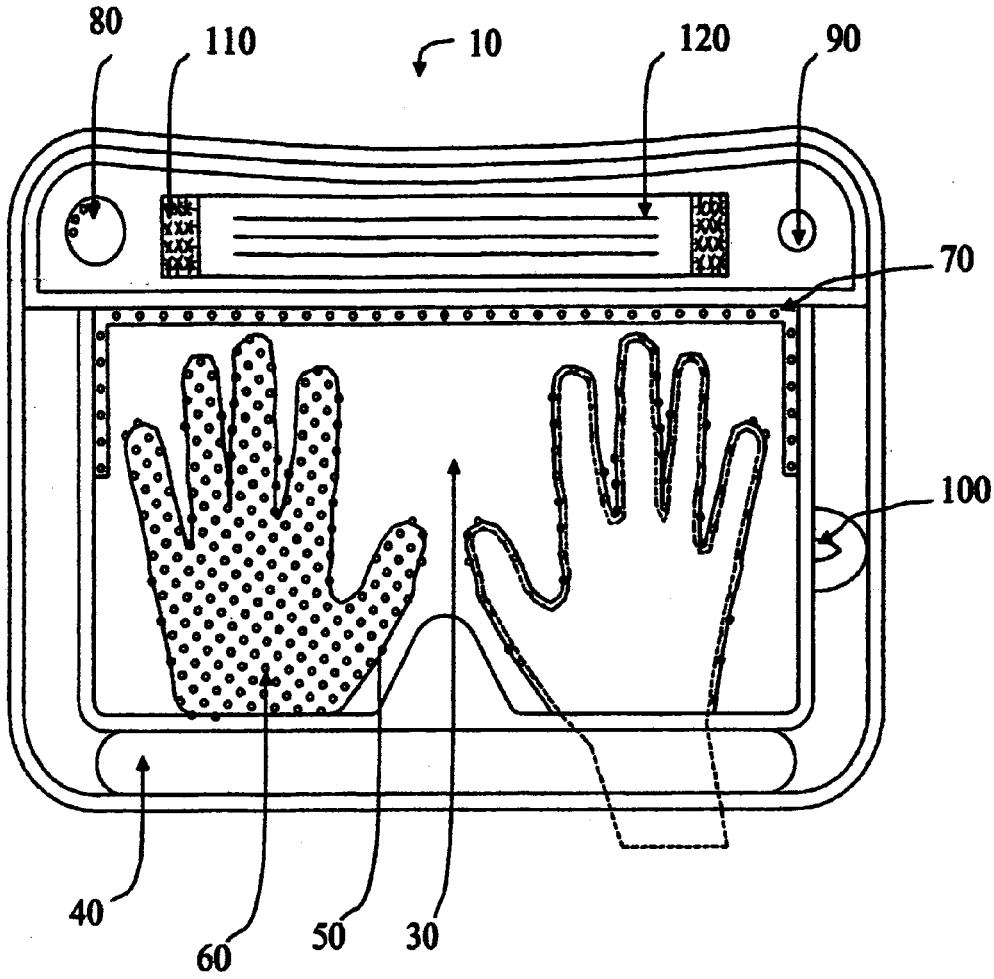
FIG. 1 is a top view of a spa manicure bath device according to at least one embodiment of the present inventions.

For the purposes of promoting an understanding of the principles of the inventions, reference will now be made to the embodiments illustrated in the drawings and specific language will be used to describe the same. It will nevertheless be understood that no limitation of the scope of the inventions is thereby intended. Any such alterations and further modifications in the illustrated device, and any such further applications of the principles of the invention as illustrated therein are contemplated herein as would normally occur to one skilled in the art to which the inventions relate. Also, the terminology used herein is for the purpose of description and not of limitation.

Figure 2:
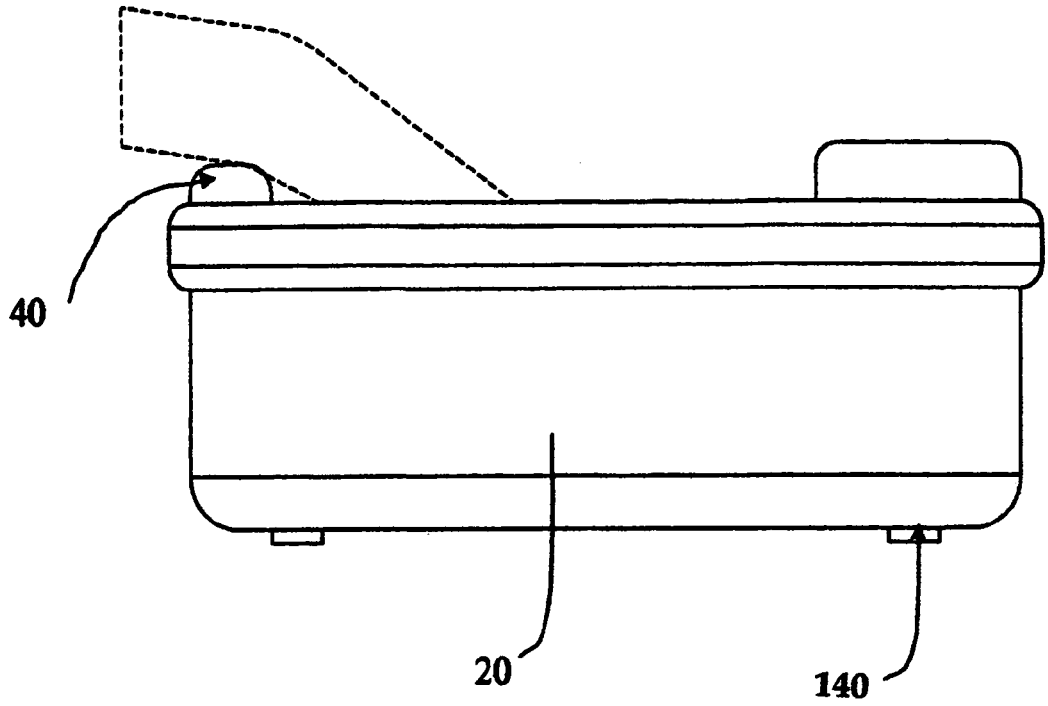
FIG. 2 is a right side view of a spa manicure bath device according to at least one embodiment of the present inventions.

Referring to FIG. 1 and FIG. 2, there is illustrated therein a top view and right side view, respectively, of a spa manicure bath device 10 according to at least one embodiment of the present inventions. Spa manicure bath device 10 is supported upon a surface that is preferably the top of a manicure table that conveniently and comfortably locates the spa manicure bath device 10 with respect to the user or person to receive a manicure. Spa manicure bath device 10 includes a housing 20 that defines a basin 30. The basin 30 retains a solution therein. The user of the spa manicure bath device 10 can place his or her hands on wrist rest 40 positioned on the housing 20 so that the hands of the user extend into the basin 30, come to rest in hand depressions 50 and are submerged in the solution. Massage beads 60 are disposed on the surface of each of the hand depressions 50.

The solution is agitated within the basin 30 by agitation means (not shown), wherein a pump or compressor agitates the solution utilizing the mini-jet assembly 70 that is disposed within the basin and housing so as to provide a continuous flow of solution about the fingers of the user. The solution is warmed above room temperature by heating means (not shown). The solution may be water, oil, or other solution useful for treating the hand and fingers.

The heating means is activated by the user turning the adjustable dial 80 from the off position to the appropriate setting, e.g. low, medium or high. The heating means is comprised of heating elements well know in the art. The agitation means is activated by depressing the mini-jet on-off button 90. The agitation means is comprised of elements well known in the art.

An implements cavity 140 is disposed in the center of the top of the housing 20 closest to the manicurist. At least one nail exfoliator 110 is disposed adjacent to the Implement cavity 140.

Filling-empting means 100 is disposed within the housing, preferably at the top right side.

The back of the housing 20 is preferably curved away from the manicurist for ease of use as well as to give a stylish appearance. A plurality of feet 120 is disposed at the bottom of the housing 20.

Figure 3:
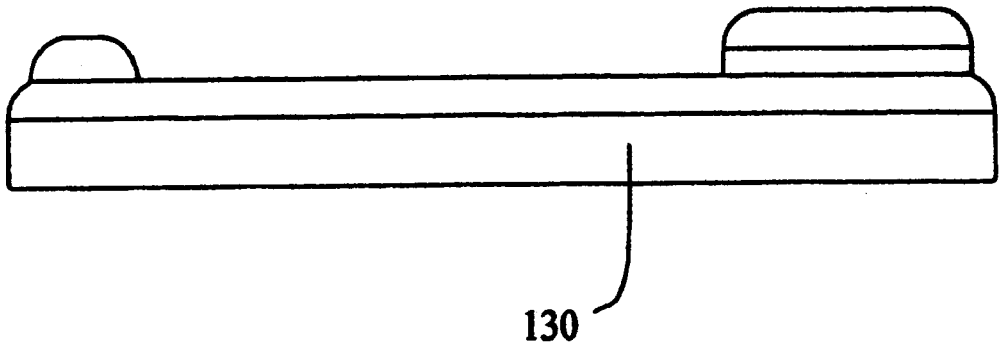
FIG. 3 is a right side view of a protective covering for a spa manicure bath device according to at least one embodiment of the present inventions.
Figure 4:
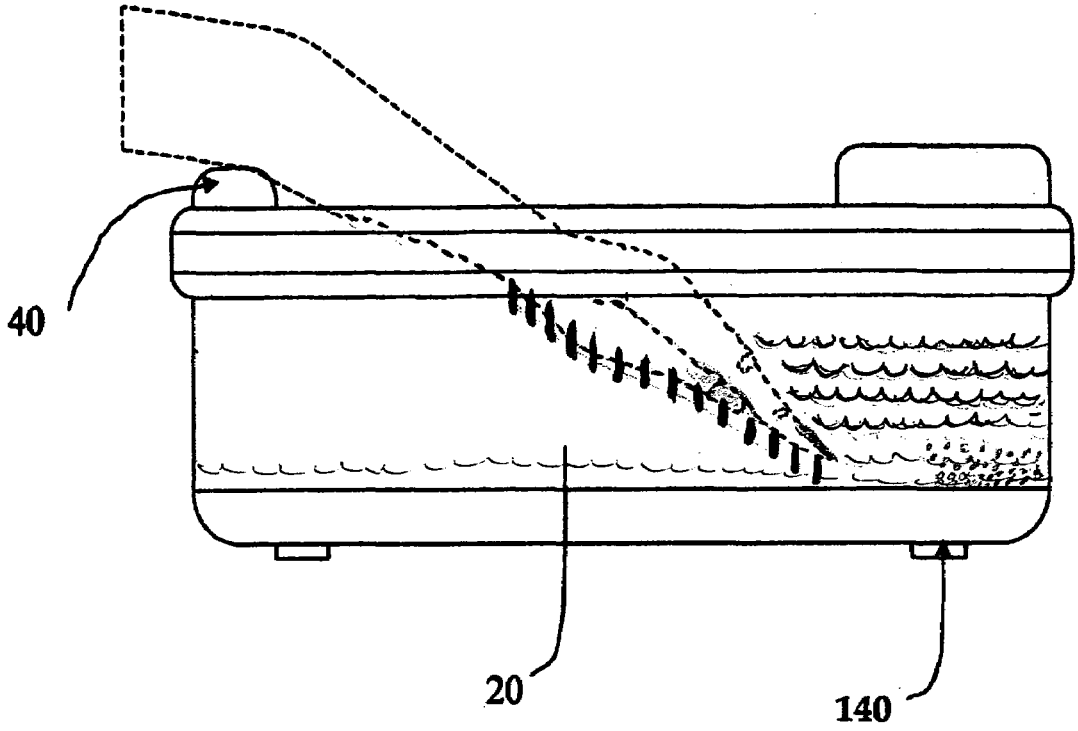
FIG. 4 is a right side view of FIG. 2 that further shows fathom lines of the user's hands.

Referring to FIG. 3, there is illustrated therein a right side view of a protective covering 130 according to at least one embodiment of the present inventions. In the preferred embodiment the protective covering 130 fits on the top side of the housing 20 when the spa manicure bath device 10 is not in use.

The spa manicure bath device 10 is used as follows:

The manicurist fills the basin 30 with the appropriate solution;

The manicurist activates the heating means by turning the adjustable dial 80 in order to create the desired temperature;

The manicurist instructs the user to insert both hands into the basin 30 such that the user's hands fit into the hand depressions 50 and rest on the massage beads 60, with the user's wrists resting on the wrist rests 40;

The manicurist activates the agitation means by depressing the mini-jet on-off button 90;

After the appropriate time has passed the manicurist removes one of the hands and works on that hand;

The manicurist turns off the heating means and agitation means;

The manicurist then removes the remaining hand and works on that hand;

At appropriate intervals the manicurist removes the solution and disinfects the basin 30.

What is claimed is:

1. A manicure spa bath device for treating two hands simultaneously, comprising:

a basin for retaining a solution, said basin comprising a proximal portion, a distal portion, a top portion, and a bottom portion, said bottom portion being slanted downwards from the proximal portion to the distal portion, two recessed areas disposed on said bottom portion, one said recessed area being in the shape of a right hand and the other said recessed area being in the shape of a left hand, a plurality of massaging beads located in both said recessed areas of said bottom portion of said basin, a wrist rest positioned on said top proximal portion of said basin, a means for agitating the solution, wherein the agitating means is located along a periphery of said bottom portion adjacent said distal portion of said basin, and a heater located within said basin.

2. The device of claim 1, further comprising a receptacle disposed on the top portion adjacent said distal portion.

3. The device of claim 2, further comprising at least one defoliating nail brush disposed in said receptacle.

4. The device of claim 3, wherein said agitating means includes an air compressor and mini-jets.

5. The device of claim 4, further comprising a plurality of feet disposed on the bottom portion of said basin.

6. The device of claim 1, further comprising a removable protective covering for said basin.

7. A manicure spa bath device for treating two hands simultaneously, comprising:

a basin for retaining a solution, said basin comprising a proximal portion, a distal portion, a top portion, and a bottom portion, said bottom portion being slanted downwards from the proximal portion to the distal portion, two recessed areas disposed on said bottom portion, one said recessed area being in the shape of a right hand and the other said recessed area being in the shape of a left hand, a plurality of massaging beads located in both said recessed areas of said bottom portion of said basin, a wrist rest positioned on said top proximal portion of said basin, a means for agitating the solution, wherein the agitating means includes an air compressor and mini-jets located along a periphery of said bottom portion adjacent said distal portion of said basin, a heater located within said basin, a receptacle disposed on the top portion adjacent said distal portion, wherein at least one defoliating nail brush is disposed in said receptacle, a plurality of feet disposed on the bottom portion of said basin, and a removable protective covering for said basin.

* * * * *